US011306575B2

(12) United States Patent
Saponja et al.

(10) Patent No.: US 11,306,575 B2
(45) Date of Patent: Apr. 19, 2022

(54) RELEASABLY CONNECTIBLE DOWNHOLE FLOW DIVERTER FOR SEPARATING GASES FROM LIQUIDS

(71) Applicant: Schlumberger Canada Limited, Calgary (CA)

(72) Inventors: Jeffrey Charles Saponja, Calgary (CA); Rob Hari, Calgary (CA); Dave Kimery, Calgary (CA); Tim Keith, Calgary (CA); Shawn Deugo, Calgary (CA)

(73) Assignee: Schlumberger Canada Limited, Calgary (CA)

( * ) Notice: Subject to any disclaimer, the term of this patent is extended or adjusted under 35 U.S.C. 154(b) by 0 days.

(21) Appl. No.: 16/520,598

(22) Filed: Jul. 24, 2019

(65) Prior Publication Data

US 2020/0032637 A1 Jan. 30, 2020

Related U.S. Application Data

(60) Provisional application No. 62/703,386, filed on Jul. 25, 2018.

(51) Int. Cl.
*E21B 43/38* (2006.01)
*E21B 43/12* (2006.01)
*E21B 17/10* (2006.01)

(52) U.S. Cl.
CPC ..... *E21B 43/38* (2013.01); *E21B 43/121* (2013.01); *E21B 17/1078* (2013.01)

(58) Field of Classification Search
CPC ..... E21B 43/38; E21B 43/121
See application file for complete search history.

(56) References Cited

U.S. PATENT DOCUMENTS 10,113,393 B2 * 10/2018 Saponja ..... E21B 43/122
2015/0075772 A1 * 3/2015 Saponja ..... E21B 43/121 166/115
2020/0131873 A1 * 4/2020 Saponja ..... E21B 23/006

FOREIGN PATENT DOCUMENTS

WO 2015143539 A1 10/2015

* cited by examiner

*Primary Examiner* — Giovanna Wright
(74) *Attorney, Agent, or Firm* — Michael Dae

(57) ABSTRACT

A reservoir production assembly for disposition within a wellbore that extends into a subterranean formation is disclosed. The reservoir production assembly includes a flow diverter including a cavity. The flow diverter defines a reservoir fluid receiver, a reservoir fluid-conducting space, a reservoir fluid discharge communicator, a gas-depleted reservoir fluid receiver, a gas-depleted reservoir fluid-conducting space, and a gas-depleted reservoir fluid discharge communicator. The reservoir production assembly includes a downhole-disposed reservoir fluid-supplying conductor for receiving the reservoir fluid from a downhole wellbore space and conducting the received reservoir fluid to the reservoir fluid receiver, and an on-off tool effecting releasable coupling of the reservoir fluid receiver of the flow diverter to the downhole-disposed reservoir fluid-supplying conductor with effect that fluid coupling of the flow diverter to the downhole-disposed reservoir fluid-supplying conductor is effected. At least a portion of the on-off tool is disposed within the cavity of the flow diverter.

23 Claims, 10 Drawing Sheets

RELEASABLY CONNECTIBLE DOWNHOLE FLOW DIVERTER FOR SEPARATING GASES FROM LIQUIDS

CROSS-REFERENCE TO RELATED APPLICATIONS

This application is claims priority from U.S. Application No. 62/703,386, filed on Jul. 25, 2018. The entire contents of this priority application is incorporated herein by reference.

FIELD

The present disclosure relates to mitigating downhole pump gas interference, and the adverse effects of solid particulate matter entrainment, during hydrocarbon production.

BACKGROUND

Downhole pump gas interference is a problem encountered while producing wells, especially wells with horizontal sections. In producing reservoir fluids containing a significant fraction of gaseous material, the presence of such gaseous material hinders production by contributing to sluggish flow. Additionally, solid particulate material is entrained in reservoir fluids, and such solid particulate matter can adversely affect production operations.

SUMMARY

In one aspect, there is provided a reservoir production assembly for disposition within a wellbore that extends into a subterranean formation and is lined with a wellbore string, wherein the reservoir production assembly comprises:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space and conducting the received reservoir fluid to the reservoir fluid receiver; and an on-off tool effecting releasable coupling of the reservoir fluid receiver of the flow diverter to the downhole-disposed reservoir fluid-supplying conductor with effect that fluid coupling of the flow diverter to the downhole-disposed reservoir fluid-supplying conductor is effected;

wherein at least a portion of the on-off tool is disposed within cavity.

In another aspect, there is provided a system including the assembly described immediately above, disposed within a wellbore.

In another aspect, there is provided parts for assembly of a reservoir fluid production assembly, comprising:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space;

wherein:

the flow diverter body includes a first counterpart of an on-off tool;

the downhole-disposed reservoir fluid-supplying conductor includes a second counterpart of the on-off tool;

the first counterpart is configured for interacting with the second counterpart such that the on-off tool is obtained, and such that fluid coupling between the reservoir fluid receiver and the downhole-disposed reservoir fluid-supplying conductor is established for effecting conducting of the received reservoir fluid to the reservoir fluid receiver; and at least a portion of the first counterpart is disposed within the cavity.

In another aspect, there is provided a reservoir production assembly for disposition within a wellbore that extends into a subterranean formation and is lined with a wellbore string, wherein the reservoir production assembly comprises:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space and conducting the received reservoir fluid to the reservoir fluid receiver; and a slideable locking mechanism effecting releasable coupling of the reservoir fluid receiver to the downhole-disposed reservoir fluid-supplying conductor such that that fluid coupling of the flow diverter to the downhole-disposed reservoir fluid-supplying conductor is effected;

wherein at least a portion of the slideable locking mechanism is disposed within the cavity.

In another aspect, there is provided a system including the reservoir production assembly described immediately above, disposed within a wellbore.

In another aspect, e is provided parts for assembly of a reservoir fluid production assembly, comprising:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space;

wherein:

the flow diverter body includes a first counterpart of a slideable locking mechanism;

the downhole-disposed reservoir fluid-supplying conductor includes a second counterpart of the slideable locking mechanism;

the first counterpart is configured for interacting with the second counterpart such that the slideable locking mechanism is obtained, and such that fluid coupling between the reservoir fluid receiver and the downhole-disposed reservoir fluid-supplying conductor is established for effecting conducting of the received reservoir fluid to the reservoir fluid receiver; and at least a portion of the first counterpart is disposed within the cavity.

BRIEF DESCRIPTION OF DRAWINGS

The preferred embodiments will now be described with reference to the following accompanying drawings.

DETAILED DESCRIPTION

As used herein, the terms "up", "upward", "upper", or "uphole", mean, relativistically, in closer proximity to the surface 106 and further away from the bottom of the wellbore, when measured along the longitudinal axis of the wellbore 102. The terms "down", "downward", "lower", or "downhole" mean, relativistically, further away from the surface 106 and in closer proximity to the bottom of the wellbore 102, when measured along the longitudinal axis of the wellbore 102.

Figure 1:
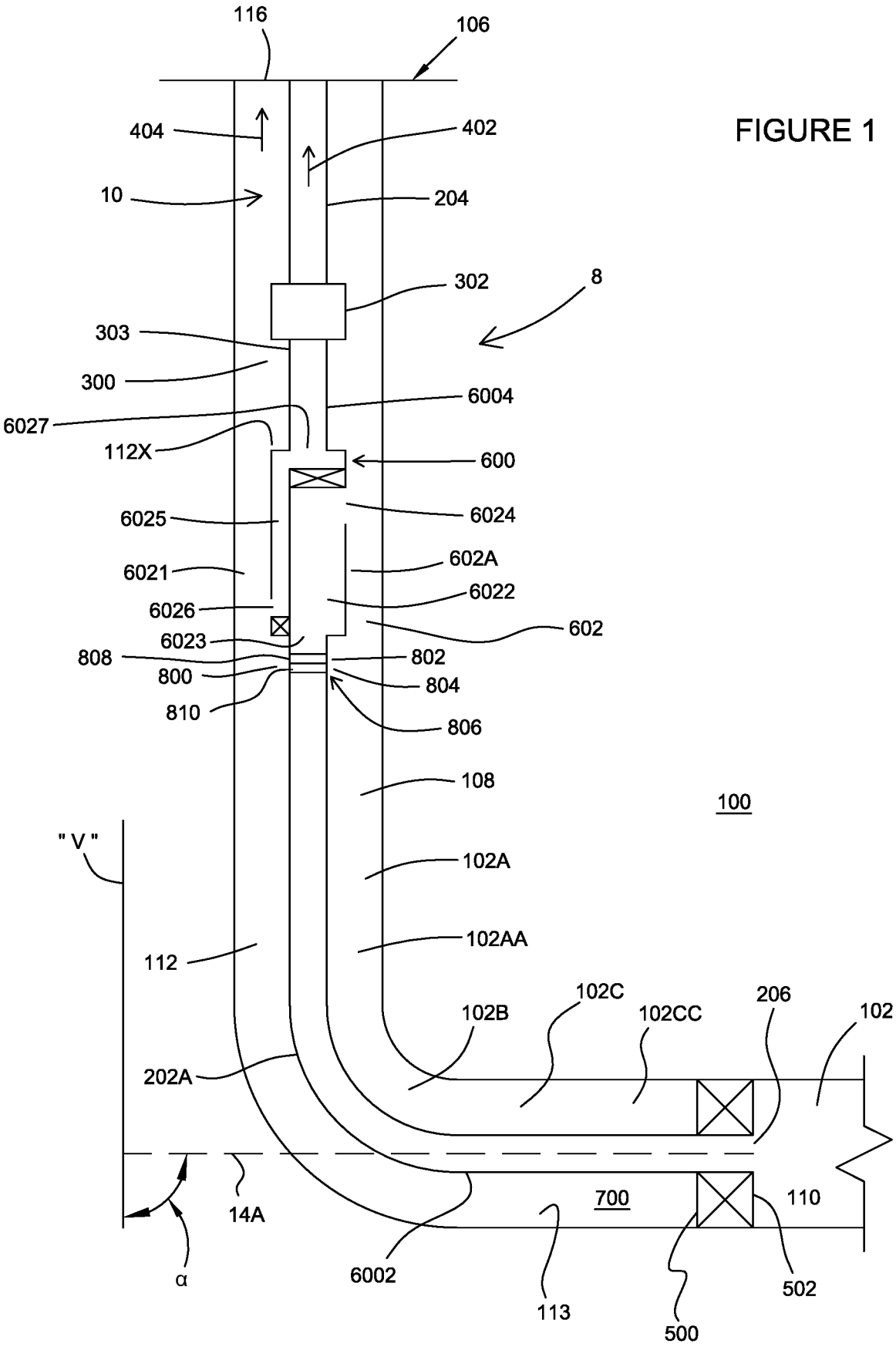
FIG. 1 is a schematic illustration of an embodiment of a system of the present disclosure.
Figure 2:
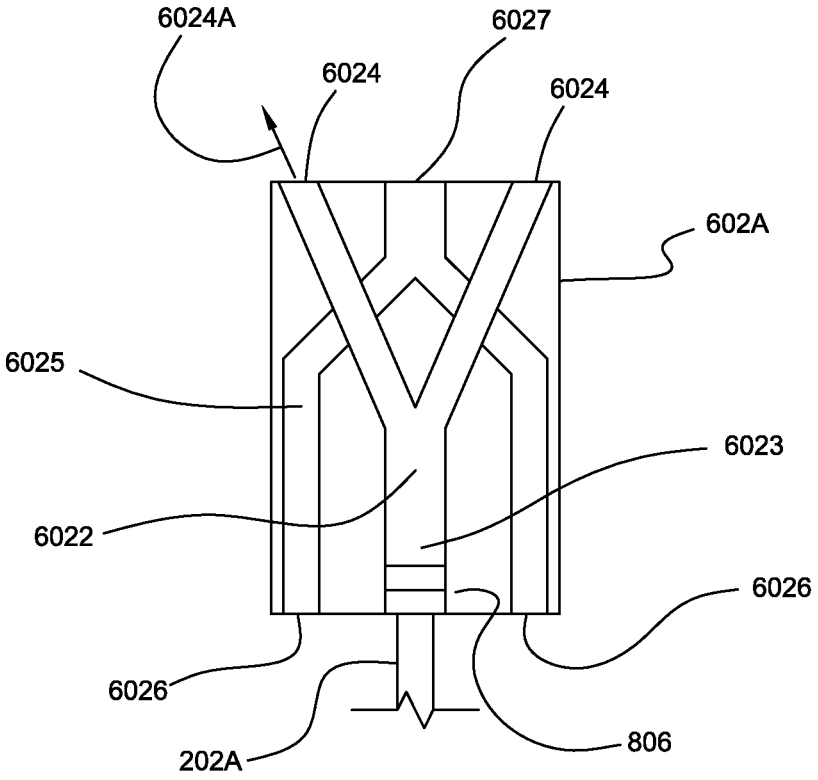
FIG. 2 is a schematic illustration of a flow diverter of embodiments of a reservoir production assembly of the present disclosure.

Referring to FIGS. 1 and 2, there are provided systems 8, with associated apparatuses, for producing hydrocarbons from a reservoir, such as an oil reservoir, within a subterranean formation 100, when reservoir pressure within the oil reservoir is insufficient to conduct hydrocarbons to the surface 106 through a wellbore 102.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. In some embodiments, for example, the central longitudinal axis of the passage 102CC of a horizontal section 102C is disposed along an axis that is between about 70 and about 110 degrees relative to the vertical "V", the central longitudinal axis of the passage 102AA of a vertical section 102A is disposed along an axis that is less than about 20 degrees from the vertical "V", and a transition section 102B is disposed between the sections 102A and 102C. In some embodiments, for example, the transition section 102B joins the sections 102A and 102C. In some embodiments, for example, the vertical section 102A extends from the transition section 102B to the surface 106.

"Reservoir fluid" is fluid that is contained within an oil reservoir. Reservoir fluid may be liquid material, gaseous material, or a mixture of liquid material and gaseous material. In some embodiments, for example, the reservoir fluid includes water and hydrocarbons, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

A wellbore string 113 is employed within the wellbore 102 for stabilizing the subterranean formation 100. In some embodiments, for example, the wellbore string 113 also contributes to effecting fluidic isolation of one zone within the subterranean formation 100 from another zone within the subterranean formation 100.

The fluid productive portion of the wellbore 102 may be completed either as a cased-hole completion or an open-hole completion.

A cased-hole completion involves running wellbore casing down into the wellbore through the production zone. In this respect, in the cased-hole completion, the wellbore string 113 includes wellbore casing.

The annular region between the deployed wellbore casing and the oil reservoir may be filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of flow communication between one or more zones of the oil reservoir and one or more others zones of the oil reservoir (for example, such as a zone that is being produced). By effecting the sealing, or substantial sealing, of such flow communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the production casing and the subterranean formation 100.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore casing and the subterranean formation 100 after the subject wellbore casing has been run into the wellbore 102. This operation is known as "cementing".

In some embodiments, for example, the wellbore casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface 106. Typically, casing string sizes are intentionally minimized to minimize costs during well construction. Generally, smaller casing sizes make production and artificial lifting more challenging.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 116. In some embodiments, for example. the annular region between the last casing string and the production tubing string may be sealed at the bottom by a packer.

The wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 8 receives the reservoir fluid.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 116. Cement may be provided within the annular region between the liner string and the oil reservoir for effecting zonal isolation (see below), but is not in all cases. In some embodiments, for example, this liner is perforated to effect flow communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead 116. In some embodiments, for example, no cemented liner is installed, and this is called an open hole completion or uncemented casing completion.

An open-hole completion is effected by drilling down to the top of the producing formation, and then lining the wellbore (such as, for example, with a wellbore string 113). The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as standalone screens, open hole gravel packs and open hole expandable screens. Packers and casing can segment the open hole into separate intervals and ported subs can be used to effect flow communication between the reservoir and the wellbore.

The system 8 includes a production string assembly 10 disposed within a wellbore 102 that is lined with a wellbore string 113. The production string assembly 10 includes a separator assembly 600, and a gas-depleted reservoir fluid production assembly 300 including a pump 302 and a gas-depleted reservoir fluid-producing conductor 204.

The assembly 10 is disposed within the wellbore string 113, such that an intermediate wellbore passage 112 is defined within the wellbore string 113, between the assembly 10 and the wellbore string 113. In some embodiments, for example, the intermediate wellbore passage 112 is an annular space disposed between the assembly 10 and the wellbore string 113. In some embodiments, for example, the intermediate wellbore passage 112 is defined by the space that extends outwardly, relative to the central longitudinal axis of the assembly 10, from the assembly 10 to the wellbore fluid conductor 113. In some embodiments, for example, the intermediate wellbore passage 112 extends longitudinally to the wellhead 116, between the assembly 10 and the wellbore string 113.

The separator assembly 600 and the wellbore string 113 are co-operatively configured for effecting supply of reservoir fluid, which has been received within a downhole-disposed wellbore space 110 of the wellbore 102 from the subterranean formation, to a reservoir fluid separation space 112X that is disposed within an uphole-disposed wellbore space 108 of the wellbore 102 such that gaseous material is separated from the reservoir fluid in response to buoyancy forces to obtain a gas-depleted reservoir fluid, and are also co-operatively configured for supplying the gas-depleted reservoir fluid to the pump 302. By effecting such separation, gas lock of the pump 302 is mitigated.

In some embodiments, for example, the separator assembly 600 and the wellbore string 113 are co-operatively configured such that, while the separator assembly 600 is disposed within the wellbore string 113, a reservoir fluid conductor 6002 is defined for conducting reservoir fluid that is received within a downhole wellbore space from the subterranean formation 100, to the reservoir fluid separation space 112X of the wellbore 102, with effect that a gas-depleted reservoir fluid is separated from the reservoir fluid within the reservoir fluid separation space 112X in response to at least buoyancy forces, and a gas-depleted reservoir fluid conductor 6004 is also defined for receiving the separated gas-depleted reservoir fluid (while the separated gas-depleted reservoir fluid is flowing in a downhole direction), and diverting the flow of the received gas-depleted reservoir fluid such that the received gas-depleted reservoir fluid is conducted by the separator assembly 600 to the pump 302.

In some embodiments, for example, the reservoir fluid conductor 6002 and the reservoir fluid separation space 112X are co-operatively configured such that, in operation, while the reservoir fluid is being supplied to the reservoir fluid separation space 112X via the reservoir fluid conductor 6002, the velocity of the gaseous portion of the reservoir fluid being conducted via the reservoir fluid conductor 6002 is greater than the critical liquid lifting velocity, and while the reservoir fluid is disposed within the reservoir fluid separation space 112X, the velocity of the gaseous portion of the reservoir fluid is sufficiently low such that the above-described separation is effected. In this respect, in some embodiments, for example, the ratio of the minimum cross-sectional flow area of the reservoir fluid separation space 112X to the maximum cross-sectional flow area of the reservoir fluid conductor 6002 is at least about 1.5.

The separator assembly 600 is fluidly coupled to the pump 302 via a conduit 303 for effecting the supplying of the gas-depleted reservoir fluid to the pump 302. The pump 302 is provided to, through mechanical action, pressurize and effect conduction of the gas-depleted reservoir fluid to the surface 106, and thereby effect production of the gas-depleted reservoir fluid. In some embodiments, for example, the pump 302 is a sucker rod pump. Other suitable pumps 302 include screw pumps, electrical submersible pumps, jet pumps, and plunger lift. The gas-depleted reservoir fluid-producing conductor 204 is fluidly coupled to the pump 302 for conducting the pressurized gas-depleted reservoir fluid to the surface 106.

The separator assembly 600 includes a flow diverter body 602A. The flow diverter body 602A is co-operatively disposed relative to the wellbore string 113 such that a flow diverter body-defined intermediate passage 6021 (such as, for example, an annular fluid passage) is disposed between the flow diverter body 602A and the wellbore string 113. The flow diverter body-defined intermediate passage 6021 forms part of the intermediate wellbore passage 112. In some embodiments, for example, the flow diverter body 602A is disposed within a vertical portion of the wellbore 102 that extends to the surface 106. An exemplary flow diverter body is illustrated in published International Application No. PCT/CA2015/000178.

The flow diverter body 602A defines a reservoir fluid-conducting space 6022 that defines a portion of the reservoir fluid conductor 6002. In some embodiments, for example, the reservoir fluid-conducting space 6022 includes one or more passages. In those embodiments where the reservoir fluid-conducting space 6022 includes a plurality of passages, in some of these embodiments, for example, two or more of the passages are interconnected. In those embodiments where the reservoir fluid-conducting space 6022 includes a plurality of passages, in some of these embodiments, for example, there is an absence of interconnection between at least some of the passages. The flow diverter body 602A also defines a reservoir fluid receiver 6023 for receiving reservoir fluid within the flow diverter body 602A and a reservoir fluid discharge communicator 6024 for discharging reservoir fluid from the flow diverter body 602A into the reservoir fluid separation space 112X. The reservoir fluid receiver 6023 is fluidly coupled to the reservoir fluid discharge communicator 6024 via the reservoir fluid-conducting space 6022. In some embodiments, for example, the reservoir fluid receiver 6023 includes one or more ports. In some embodiments, for example, the reservoir fluid discharge communicator 6024 includes one or more ports. In some embodiments, for example, the flow diverter 602 is disposed within the wellbore 102 such that the reservoir fluid receiver 6023 is disposed downhole relative to the reservoir fluid discharge communicator 6024.

Referring to FIG. 2, in some embodiments, for example, the reservoir fluid discharge communicator 6024 is oriented such that, a ray (see, for example ray 6024A), that is disposed along the central longitudinal axis of the reservoir fluid discharge communicator 6024, is disposed in an uphole direction at an acute angle of less than 30 degrees relative to the central longitudinal axis of the wellbore portion within which the flow diverter body 602A is disposed.

The flow diverter body 602A also defines a gas-depleted reservoir fluid-conducting space 6025 that defines a portion of the gas-depleted reservoir fluid conductor 6004. In some embodiments, for example, the gas-depleted reservoir fluid-conducting space 6025 includes one or more passages. In those embodiments where the reservoir fluid-conducting space 6025 includes a plurality of passages, in some of these embodiments, for example, two or more of the passages are interconnected. In those embodiments where the reservoir fluid-conducting space 6025 includes a plurality of passages, in some of these embodiments, for example, there is an absence of interconnection between at least some of the passages. The flow diverter body 602A also defines a gas-depleted reservoir fluid receiver 6026 for receiving gas-depleted reservoir fluid within the flow diverter body 602A and a gas-depleted reservoir fluid discharge communicator 6027 for discharging gas-depleted reservoir fluid from the flow diverter body 602A for supplying to the pump 302. The gas-depleted reservoir fluid receiver 6026 is fluidly coupled to the gas-depleted reservoir fluid discharge communicator 6027 via the gas-depleted reservoir fluid-conducting space 6025. In some embodiments, for example, the gas-depleted reservoir fluid receiver 6026 includes one or more ports. In some embodiments, for example, the gas-depleted reservoir fluid discharge communicator 6027 includes one or more ports. The flow diverter 602 is disposed within the wellbore 102 such that the gas-depleted reservoir fluid receiver 6026 is disposed downhole relative to the gas-depleted reservoir fluid discharge communicator 6027.

The system 8 receives, via the wellbore 102, the reservoir fluid flow from the reservoir 100. As discussed above, the wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 8 receives the reservoir fluid.

In this respect, the separator assembly 600 also includes a reservoir fluid-supplying conductor 202A for conducting the reservoir fluid, which is received within a downhole-disposed wellbore space 110 of the wellbore 102, from the downhole-disposed wellbore space 110 and uphole to the reservoir fluid receiver 6023 of the flow diverter body 602A.

In this respect, the reservoir fluid-supplying conductor 202A defines a portion of the reservoir fluid conductor 6002, and the reservoir fluid-supplying conductor 202A and the flow diverter body 602A are co-operatively configured such that, while reservoir fluid is being received within the downhole-disposed wellbore space 110, the reservoir fluid is conducted uphole from the downhole-disposed wellbore space 110 to the reservoir fluid separation space 112X via at least the reservoir fluid-supplying conductor 202A, the reservoir fluid receiver 6023, the reservoir fluid-conducting space 6022, and the reservoir fluid discharge communicator 6024.

In some embodiments, for example, the ratio of the minimum cross-sectional flow area of the reservoir fluid separation space 112X to the maximum cross-sectional flow area of the reservoir fluid-supplying conductor 202A is at least about 1.5. In this respect, in some embodiments, for example, the reservoir fluid-supplying conductor 202A defines a velocity string, and the maximum cross-sectional flow area of the velocity string is less than the minimum cross-sectional flow area of the gas-depleted reservoir fluid-producing conductor 204.

In some embodiments, for example, the length of the reservoir fluid-supplying conductor 202A, as measured along the central longitudinal axis of the reservoir fluid-supplying conductor 202A, is at least 500 feet, such as, for example, at least 750 feet, such as, for example at least 1000 feet. In some of these embodiments, for example, the reservoir fluid-supplying conductor 202A includes a receiver 206 (e.g. an inlet port) for receiving the reservoir fluid from the downhole wellbore space 110, and the receiver 206 is disposed within the horizontal section 102C of the wellbore 102.

As above-described, reservoir fluid is discharged into the reservoir fluid separation space 112X from the reservoir fluid discharge communicator 6024. In this respect, in some embodiments, for example, the reservoir fluid separation space 112X is disposed uphole relative to the reservoir fluid discharge communicator 6024. While reservoir fluid is disposed within the reservoir fluid separation space 112X, after having been discharged from the reservoir fluid discharge communicator 6024, gas-depleted reservoir fluid is separated from the reservoir fluid within the reservoir fluid separation space 112X in response to at least buoyancy forces such that a gas-depleted reservoir fluid and a liquid-depleted reservoir fluid are obtained.

The gas-depleted reservoir fluid receiver 6026 is disposed in flow communication with the reservoir fluid separation space 112X via the flow diverter body-defined intermediate passage 6021 for receiving the separated gas-depleted reservoir fluid. In this respect, the gas-depleted reservoir fluid receiver 6026 is disposed downhole relative to the reservoir fluid separation space 112X. In some embodiments, for example, the gas-depleted reservoir fluid receiver 6026 is also disposed downhole relative to the reservoir fluid discharge communicator 6024. For preventing, or substantially preventing, bypassing of the gas-depleted reservoir fluid receiver 6026 by gas-depleted reservoir fluid that has been separated from the reservoir fluid within the reservoir fluid separation space 112X, the system 8 also includes a sealed interface 500 for preventing, or substantially preventing, bypassing of the gas-depleted reservoir fluid receiver 6026 by gas-depleted reservoir fluid that has been separated from the reservoir fluid within the reservoir fluid separation space 112X. In some embodiments, for example, establishing of the sealed interface 500 is effected by a sealed interface effector 502 of the separator assembly 600, such as, for example, a packer, while the sealed interface effector 502 is disposed in sealing engagement, or substantially sealing engagement, with the wellbore string 113.

In some embodiments, for example, the sealed interface 500 is defined within the wellbore 102, between: (a) an uphole wellbore space 108 of the wellbore 102 (the uphole wellbore space 108 including the reservoir fluid separation space 112X), and (b) the downhole wellbore space 110 of the wellbore 102. In some embodiments, for example, the disposition of the sealed interface 500 is such that flow communication, via the intermediate wellbore passage 112, between the uphole wellbore space 108 and the downhole wellbore space 110 (and across the sealed interface 500), is prevented, or substantially prevented. In some embodiments, for example, the disposition of the sealed interface 500 is such that fluid flow, across the sealed interface 500, in a downhole direction, from the uphole wellbore space 108 to the downhole wellbore space 110, is prevented, or substantially prevented. In this respect, the sealed interface 500 functions to prevent, or substantially prevent, gas-depleted reservoir fluid flow, that is separated from the reservoir fluid within the reservoir fluid separation space 112X, from bypassing the gas-depleted reservoir fluid receiver 6026, and, as a corollary, the gas-depleted reservoir fluid is directed to the gas-depleted reservoir fluid receiver 6026 for effecting supply of the gas-depleted reservoir fluid to the pump 302.

Referring to FIG. 1, in some embodiments, for example, the sealed interface 500 is disposed within a section of the wellbore 102 whose axis 14A is disposed at an angle "α" of at least 60 degrees relative to the vertical "V". In some of these embodiments, for example, the sealed interface 500 is disposed within a section of the wellbore whose axis is disposed at an angle "60 " of at least 85 degrees relative to the vertical "V". In this respect, disposing the sealed interface 500 within a wellbore section having such wellbore inclinations minimizes solid debris accumulation at the sealed interface 500.

In some embodiments, for example, the reservoir fluid-supplying conductor 202A, the flow diverter body 602A, the sealed interface 500, and the pump 302 are co-operatively configured such that, while the reservoir fluid-supplying conductor 202A is receiving reservoir fluid, from the downhole wellbore space 110, that has been received within the downhole wellbore space 110 from the subterranean formation 100:

- the reservoir fluid is supplied to the reservoir fluid separation space 112X via the reservoir fluid receiver 6023, the reservoir fluid-conducting space 6022, and the reservoir fluid discharge communicator 6024;
- within the reservoir fluid separation space 112X, a gas-depleted reservoir fluid is separated from the supplied reservoir fluid, in response to at least buoyancy forces, such that the gas-depleted reservoir fluid is obtained;
- bypassing of the gas-depleted reservoir fluid receiver 6026 by the gas-depleted reservoir fluid, is prevented, or substantially prevented, by the sealed interface 500 such that the gas-depleted reservoir fluid is received by the gas-depleted reservoir fluid receiver 6026; and
- the received gas-depleted reservoir fluid is supplied to the pump 302.

Once received by the pump 302, the gas-depleted reservoir fluid is pressurized by the pump 302 and conducted as a flow 402 to the surface via the gas-depleted reservoir fluid-producing conductor 204. In this respect, the gas-depleted reservoir fluid-producing conductor 204 extends from the pump 302 to the wellhead 116 for effecting flow communication between the pump 302 and the earth's surface 106, such as, for example, a collection facility located at the earth's surface 106. In some embodiments, for example, the minimum cross-sectional flow area of the gas-depleted reservoir fluid-producing conductor 204 is greater than the maximum cross-sectional flow area of the reservoir fluid-supplying conductor 202A. In some embodiments, for example, the ratio of the cross-sectional flow area of the conductor 204 to the cross-sectional flow area of the conductor 202A is at least 1.1, such as, for example, at least 1.25, such as, for example, at least 1.5.

In parallel, the separation of gaseous material from the reservoir fluid is with effect that a liquid-depleted reservoir fluid is obtained and is conducted uphole (in the gaseous phase, or at least primarily in the gaseous phase with relatively small amounts of entrained liquid) as a flow 404 via the intermediate wellbore passage 112 that is disposed between the assembly 10 and the wellbore string 113 (see above).

The reservoir fluid produced from the subterranean formation 100, via the wellbore 102, including the gas-depleted reservoir fluid, the liquid-depleted reservoir material, or both, may be discharged through the wellhead 116 to a collection facility, such as a storage tank within a battery.

In some embodiments, for example, the uphole-disposed wellbore space 108 includes a sump space 700, and the sump space 700 is disposed: (i) downhole relative to the gas-depleted reservoir fluid receiver 6026, and (ii) uphole relative to the sealed interface 500. The sump space 700 is provided for collecting solid particulate material that gravity separates from the reservoir fluid that is supplied to the reservoir fluid separation space 112X. In some embodiments, for example, the gas-depleted reservoir fluid receiver 6026 is oriented in a downhole direction such that the gas-depleted reservoir fluid, that is flowing downhole to the gas-depleted reservoit fluid receiver 6026 via the flow diverter body-defined intermediate passage 6021, prior to being received by the gas-depleted reservoir fluid receiver 6026, reverses direction and flows in an uphole direction into the gas-depleted reservoir fluid receiver 6026. During the flow reversal, separation of at least a fraction of solid particulate material, that is entrained within the gas-depleted reservoir fluid, from the reservoir fluid is encouraged, resulting in gravity settling of the separated solid particulate material within the sump space In some embodiments, for example, at least a fraction of the sump space 700 is disposed within the vertical section 102A of the wellbore 102. In some embodiments, for example, at least a majority of the sump space 700 is disposed within the vertical section 102A of the wellbore 102. In some embodiments, for example, the sump space 700 has a volume of at least 0.1 $m^3$. In some embodiments, for example, the volume is at least 0.5 $m^3$. In some embodiments, for example, the volume is at least 1.0 $m^3$. In some embodiments, for example, the volume is at least 3.0 $m^3$. By providing for the sump space 700, a suitable space is provided for collecting relative large volumes of solid debris that has separated from the reservoir fluid, such that interference by the accumulated solid debris with the production of oil through the system is mitigated. This increases the run-time of the system before any maintenance is required.

The reservoir fluid receiver 6023 of the flow diverter body 602A is fluidly coupled to the reservoir fluid-supplying conductor 202A via a releasable locking mechanism 800 that effects releasable locking of the flow diverter body 602A to the reservoir fluid-supplying conductor 202A. The releasable locking mechanism 800 is at least partially disposed within a cavity 640 of the flow diverter body 602A. In some embodiments, for example, the entirety, or the substantial entirety, of the releasable locking mechanism 800 is disposed within the cavity 640. In disposing the releasable connector 800, relative to the flow diverter body 602A, in the manner above-described, accumulation of solid debris relative to the releasable connector 800, which could interfere with release of the flow diverter body 602A from the reservoir fluid-supplying conductor 202A, is mitigated. In this respect, the assembly 10 further includes the releasable locking mechanism 800.

In this respect, a releasably connectible uphole production assembly 601, including a releasably connectible flow diverter body 602 that is fluidly coupled to the gas-depleted reservoir fluid production assembly 300 for supplying gas-depleted reservoir fluid to the gas-depleted reservoir fluid production assembly 300, is provided. The releasably connectible flow diverter body 602 includes the flow diverter body 602A and a first locking mechanism counterpart 802. Correspondingly, a releasably connectible downhole production assembly 202 is provided, and the releasably connectible downhole production assembly 202 includes the reservoir fluid-supplying conductor 202A and a second locking mechanism counterpart 804. The releasable connection of the flow diverter body 602A to the reservoir fluid supplying conductor 202A is effected by releasable connection of the first and second connector counterparts 802, 804, and the releasable connection of the first and second connector counterparts 802, 804 establishes fluid communication between the reservoir fluid receiver 623 of the flow diverter body 602A and the reservoir fluid-supplying conductor 202A. In some embodiments, for example, the releasable locking mechanism 800 is a slidable locking mechanism and, in this respect, the connection and disconnection is effected by slidable movement of first counterpart 802 relative to the second connector counterpart 804. In some embodiments, for example, the slidable movement includes a rotational component.

For establishing this fluid communication, the first locking mechanism counterpart 802 includes an internal surface that defines a passage that is disposed in flow communication with the reservoir fluid receiver 623 of the flow diverter body 602A, and the second locking mechanism counterpart 804 includes an internal surface that defines a passage that is disposed in flow communication with the reservoir fluid-supplying conductor 202A.

In some embodiments, for example, the releasable locking mechanism 800 includes an on-off tool 806, and the on-off tool 806 is at least partially disposed within the cavity 640.

In this respect, in some embodiments, for example, the uppermost surface 806A of the on-off tool 806 is disposed within the cavity 640. In some embodiments, for example, wherein at least 50% of the total volume, such as, for example, at least 60% of the total volume of the on-off tool 806, such as, for example, at least 70% of the total volume of the on-off tool 806, such as, for example, at least 80% of the total volume of the on-off tool 806 is disposed within the cavity 640. In some embodiments, for example, the on-off tool 806 includes a tool-based solid particulate accumulation-susceptible region 806B defined by that portion of the outermost surface of the on-off tool 806 that, while the assembly 10 is disposed within the wellbore 102, is facing uphole and is traversed by a longitudinal axis of the wellbore 102, and at least 50% of the total surface area of the tool-based solid particulate accumulation-susceptible region 806B, such as, for example, at least 60% of the total surface area of the tool-based solid particulate accumulation-susceptible region 806B, such as, for example, at least 70% of the total surface area of the tool-based solid particulate accumulation-susceptible region 806B, such as, for example, at least 80% of the total surface area of the tool-based solid particulate accumulation-susceptible region 806B, is disposed within the cavity 640. In some embodiments, for example, the disposition of the at least a portion of the on-off tool 806 within the cavity 640 is with effect that the at least a portion of the on-off tool 806 is shielded, or substantially shielded, from solid particulate matter within the reservoir fluid while the solid particulate matter is being conducted from the reservoir fluid separation space 112X to the gas-depleted reservoir fluid receiver 6026.

Figure 6:
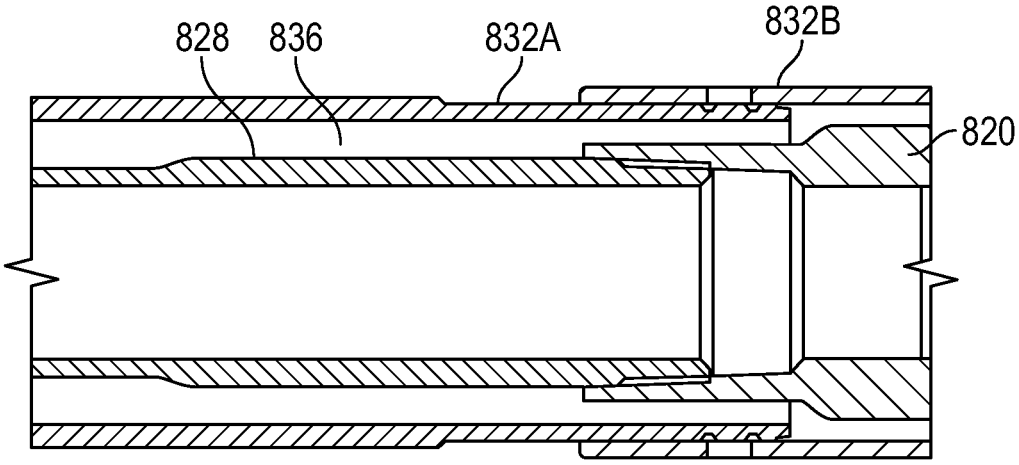
FIG. 6 is an enlarged view of Detail "B" in FIG. 4.

In some embodiments, for example, at least a portion of the first counterpart 802 is disposed within the cavity 640. Referring to FIG. 6, in some embodiments, for example, the interaction with the second counterpart 804, for which the first counterpart 802 is configured, establishes a joint 803, wherein the joint 803 is disposed within the cavity 640. In some embodiments, for example, at least 50% of the total volume of the first counterpart 802, such as, for example, at least 60% of the total volume of the first counterpart 802, such as, for example, at least 70% of the total volume of the first counterpart 802, such as, for example, at least 80% of the total volume of the first counterpart 802, is disposed within the cavity 640. In some embodiments, for example, the first counterpart 802 includes a first counterpart-based solid particulate accumulation-susceptible region 802A defined by that portion of the outermost surface of the first counterpart 802 that, while: (i) the first counterpart 802 is interacting with the second counterpart 804 such that the on-off tool 806 is obtained, and (ii) the on-off tool 806 is disposed within the wellbore 102, is facing uphole and is traversed by a longitudinal axis of the wellbore 102, and the disposition of the at least a portion of the first counterpart 802 within the cavity 640 is such that at least 50% of the total surface area of the first counterpart-based solid particulate accumulation-susceptible region 802A, such as, for example, at least 60% of the total surface area of the first counterpart-based solid particulate accumulation-susceptible region 802A, such as, for example, at least 70% of the total surface area of the first counterpart-based solid particulate accumulation-susceptible region 802A, such as, for example, at least 80% of the total surface area of the first counterpart-based solid particulate accumulation-susceptible region 802A is disposed within the cavity 640. In some embodiments, for example, the disposition of the at least a portion of the first counterpart 802 within the cavity 640 is with effect that, while the assembly 10 including the first counterpart 802, is disposed within the wellbore 102, the at least a portion of the first counterpart 802 is shielded, or substantially shielded, from solid particulate matter within the reservoir fluid while the solid particulate matter is being conducted from the reservoir fluid separation space 112X to the gas-depleted reservoir fluid receiver 6026.

Figure 3:
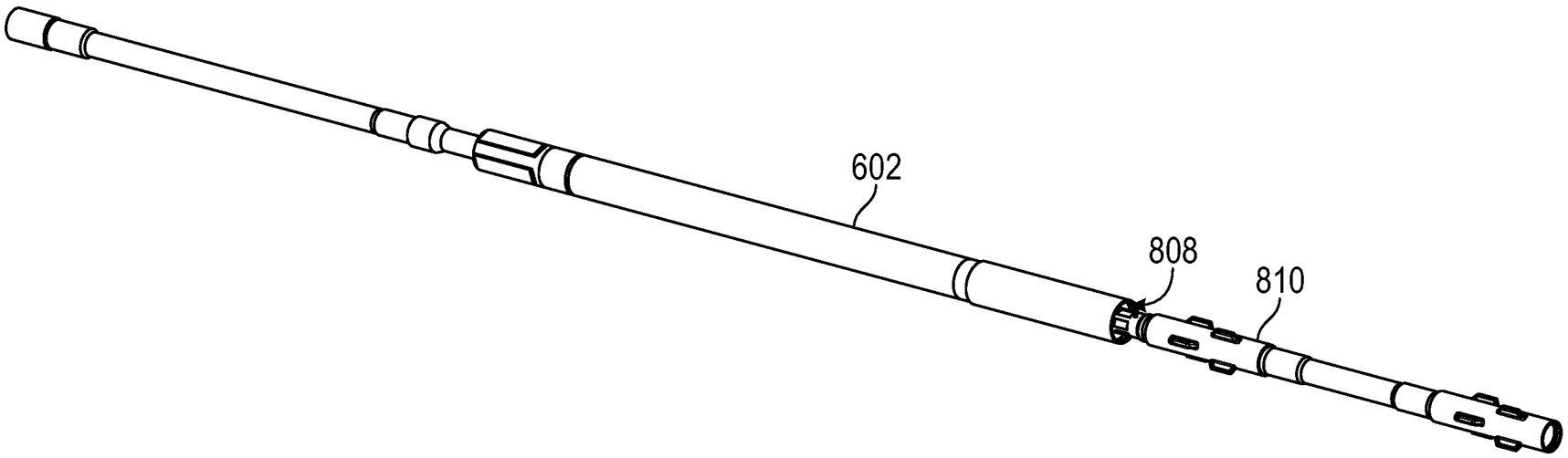
FIG. 3 is a schematic illustration of a flow diverter body coupled to an on/off tool of embodiments of a reservoir production assembly of the present disclosure.
Figure 4:
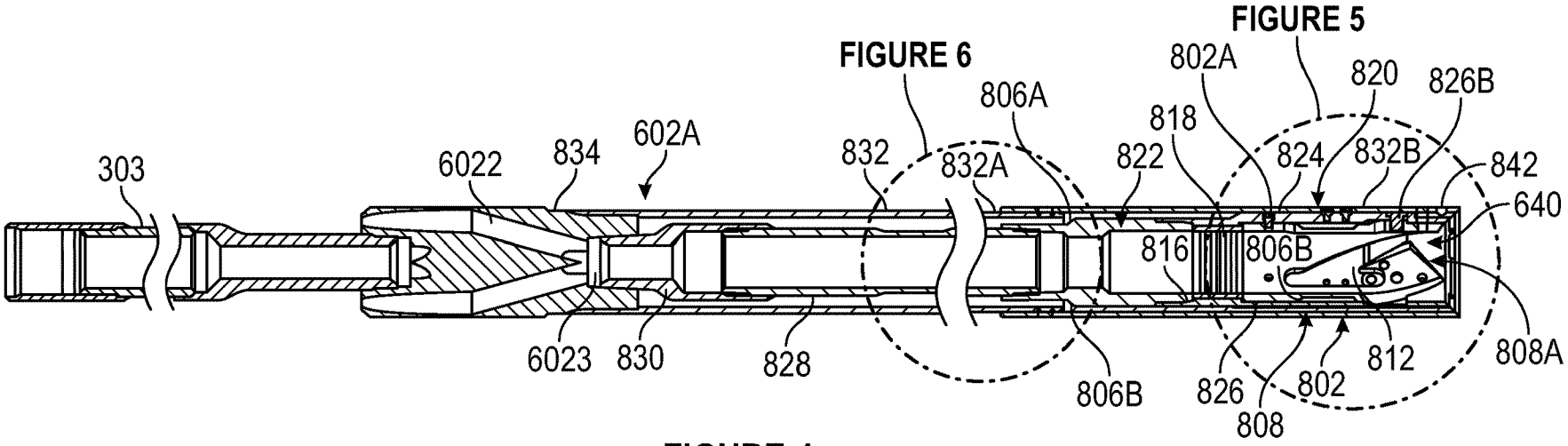
FIG. 4 is a sectional view of a portion of an embodiment of a reservoir production assembly of the present disclosure, illustrating the flow diverter body and the overshot.
Figure 5:
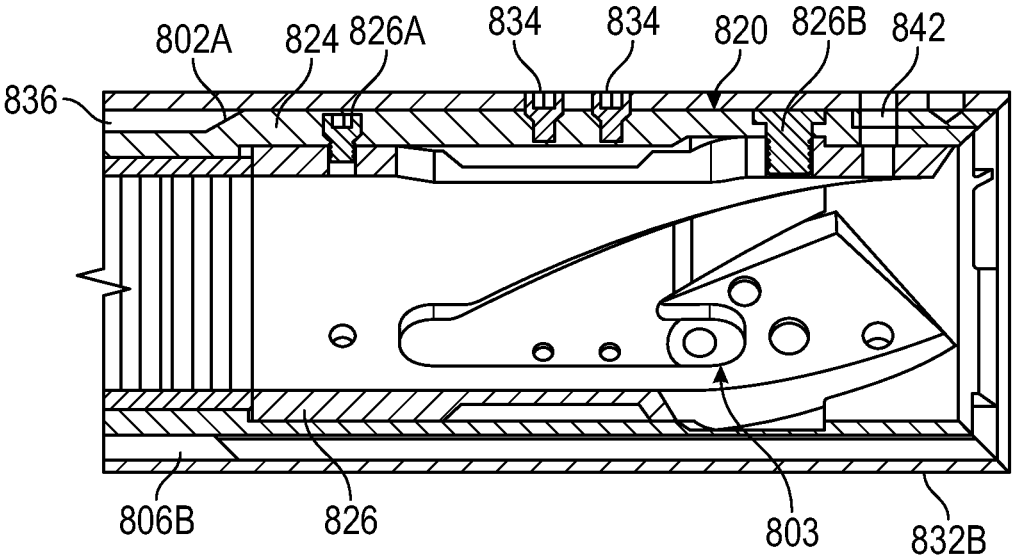
FIG. 5 is an enlarged view of Detail "C" in FIG. 4.

Referring to FIG. 3, in some embodiments, for example, the on-off tool 806 includes an overshot 808 and a stinger 810. In this respect, the first locking mechanism counterpart 802 includes the overshot 808 and the second locking mechanism counterpart 804 includes the stinger 810. Referring to FIGS. 4 to 6, the overshot 808 is configured to receive insertion of the stinger 810 for effecting the releasable connection of the flow diverter body 602A to the reservoir fluid-supplying conductor 202A such that fluid coupling of the reservoir fluid receiver 623 with the reservoir fluid-supplying conductor 202A is established. In this respect, the stinger 810 includes a fluid passage 810A for receiving and conducting reservoir fluid that is being conducted by the reservoir fluid-supplying conductor 202A. Relatedly, the overshot 808 includes a passage 808A that is configured to receive insertion of the stinger 810, and is co-operatively configured with the stinger 810 such that, while the stinger 810 is disposed within the passage 808A, the passage 808A is disposed for receiving and conducting reservoir fluid being conducted by the releasably connectible downhole production assembly 202.

In some embodiments, for example, the overshot 808 defines a j-slot 812, and the stinger 810 includes one or more lugs 814, and the overshot 808 and the stinger 810 are co-operatively configured such that, in response to insertion of the stinger 810 within the overshot 808, the lugs 814 are received within the j-slot 812 (see FIG. 6) for effecting the releasable connection of the flow diverter body 602A to the reservoir fluid supplying conductor 202A.

In some embodiments, for example, the overshot 808 and the stinger 810 are co-operatively configured such that, while the overshot 808 is releasably coupled to the stinger 810, a sealed interface 816 is defined (such as, for example, a sealing member 816A) for preventing, or substantially preventing, bypassing of the fluid passage of the overshot 808 by material that is flowing through the fluid passage of the stinger 810 in the uphole direction, such as by egress of material being conducted by the fluid passage, across a joint between the overshot 808 and the stinger 810. In some embodiments, for example, the release of the overshot 808 from the releasable coupling to the stinger 810, is with effect that the sealed interface 816 is defeated. In some embodiments, for example, the sealed interface 816 is defined by a sealing engagement, or substantially sealing engagement, between the overshot 808 and the stinger 810 and, in this respect, is effected by a sealing member 818 that is carried within the housing 820 of the overshot 808.

Figure 7:
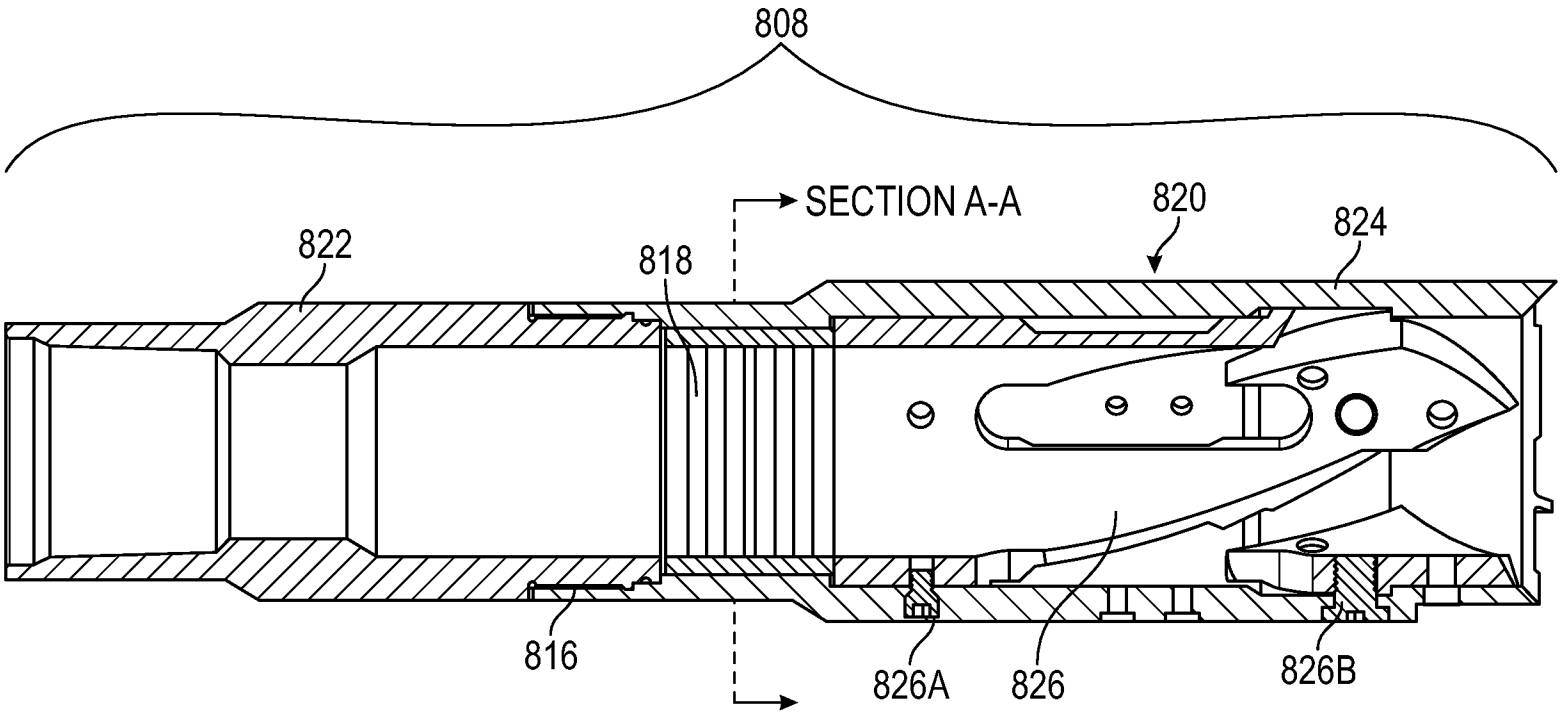
FIG. 7 is a sectional view of an overshot of embodiments of a reservoir production assembly of the present disclosure.
Figure 8:
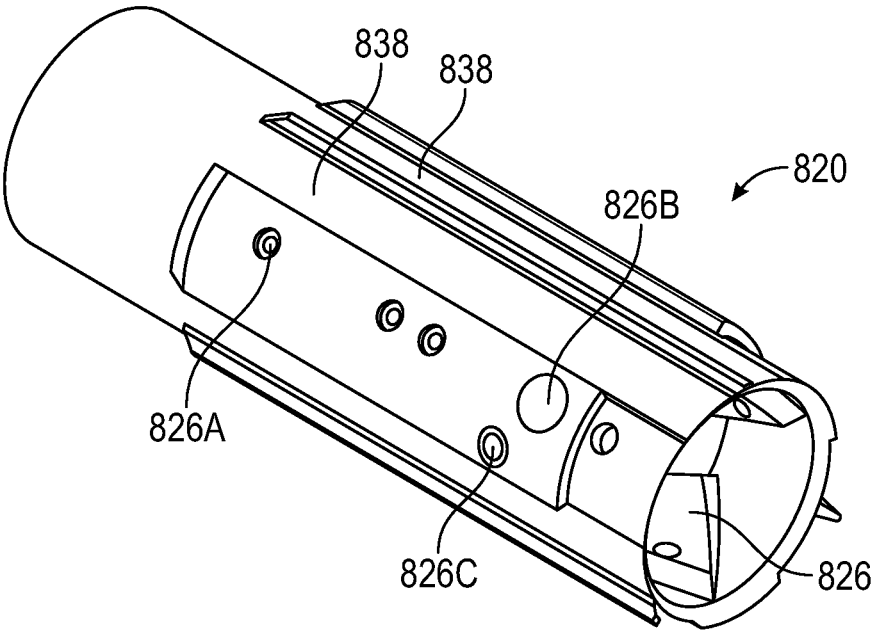
FIG. 8 is a perspective view of a housing of an overshot of embodiments of a reservoir production assembly of the present disclosure
Figure 9:
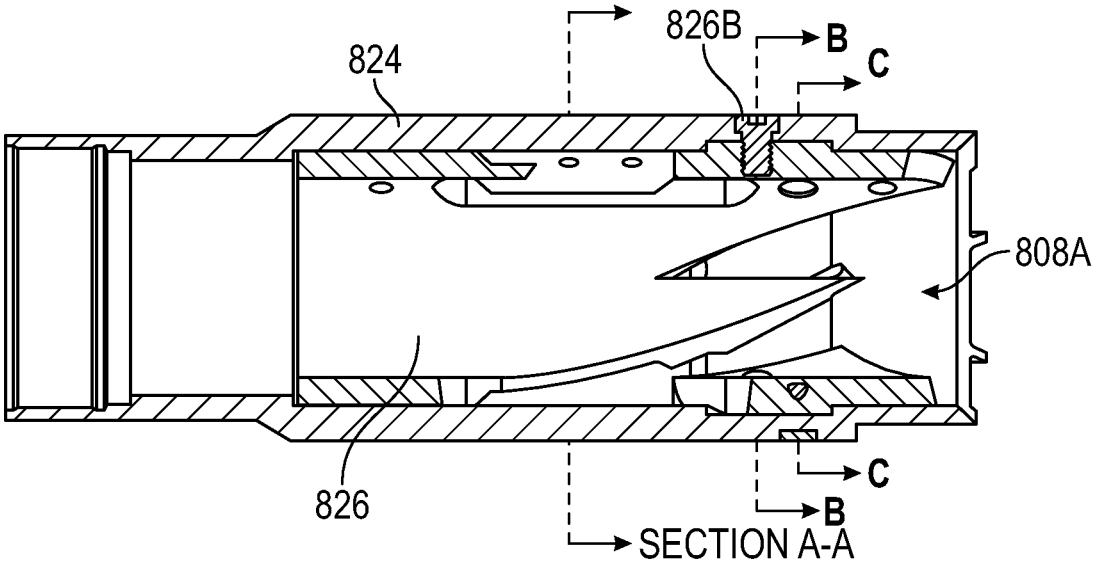
FIG. 9 is a sectional view of the housing illustrated in FIG. 8.
Figure 10:
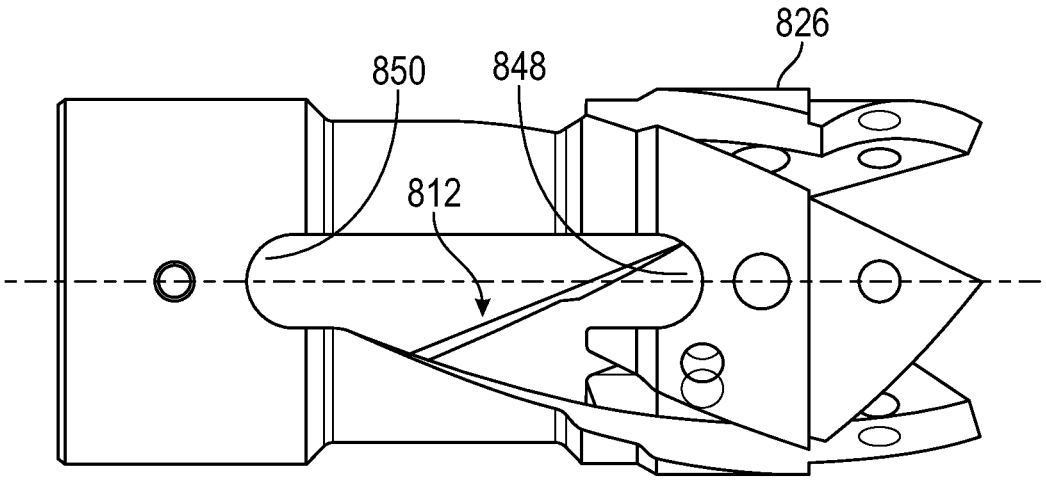
FIG. 10 is a sectional view of the j-slot insert of a reservoir production assembly of the present disclosure.
Figure 11:
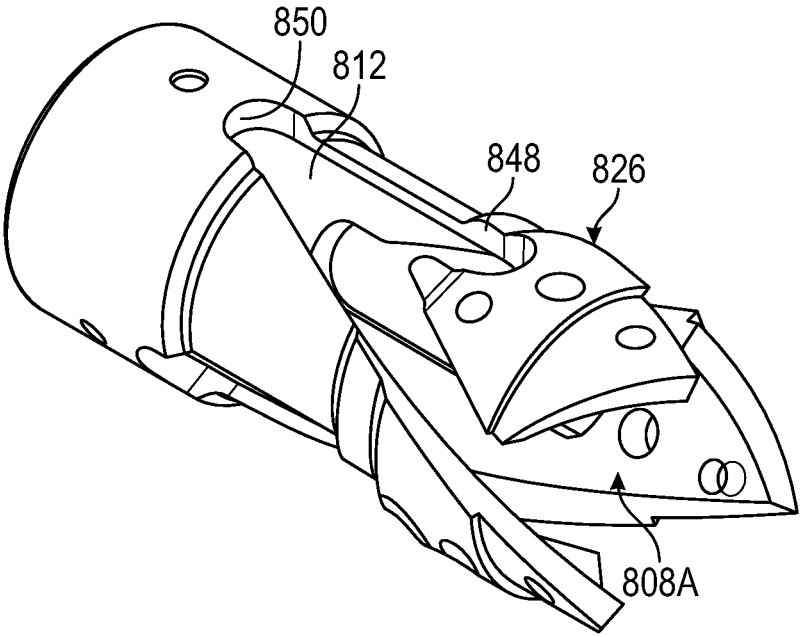
FIG. 11 is a perspective view of the j-slot insert illustrated in FIG. 10.

Referring to FIG. 7, in some embodiments, for example, the overshot 808 is an assembly including the housing 820 and a top sub 822. The housing 820 is threaded to the top sub 822. Referring to FIGS. 8 and 9, the housing 820 includes a body 824 and a j-slot defining insert 826 (see FIGS. 10 and 11) that defines the j-slot 812. The j-slot defining insert 826 is received within a receptacle of the body 824 and fastened to the body 824 with fasteners 826A, 826B, and 826C.

In some embodiments, for example, the overshot 808 is connected (such as, for example, threadably connected) to the flow diverter body 602A via a connector (including for example, a tube joint 828 and a cross-over sub 830) such that flow communication between the passage 808A and the reservoir fluid receiver 6023 is effected, thereby enabling conduction of reservoir fluid, being received within the wellbore 102, to the flow diverter body 602A.

In some embodiments, for example, the flow diverter body 602A includes a shroud assembly 832 depending from a main body 834 for defining the cavity 640 within which the releasable locking mechanism 800 is at least partially disposed, as above-described. In the illustrated embodiment, for example, the shroud assembly 832 is assembled by coupling of an upper shroud 832A to a lower shroud 832B via a slip joint. In some embodiments, for example, the upper shroud 832A is connected to the flow diverter body 602A with suitable fasteners, and the lower shroud is connected to the overshot 808 (such as, for example the housing 820) with suitable fasteners 834 In some embodiments, for example, the space 836 (for example, an annular space), between the shroud assembly 832 and the assembly of the cross-over sub 830, the tube joint 808, and the overshot 808, defines a portion of the gas-depleted reservoir fluid-conducting space 6025, and the downhole terminus of the shroud assembly 832 defines the gas-depleted reservoir fluid receiver 6026. In some embodiments, for example, channels 838 are defined within the exterior surface of the housing 820 for facilitating flow of the gas-depleted reservoir fluid through the space 836 between the shroud assembly 832 and the overshot 808.

Figure 12:
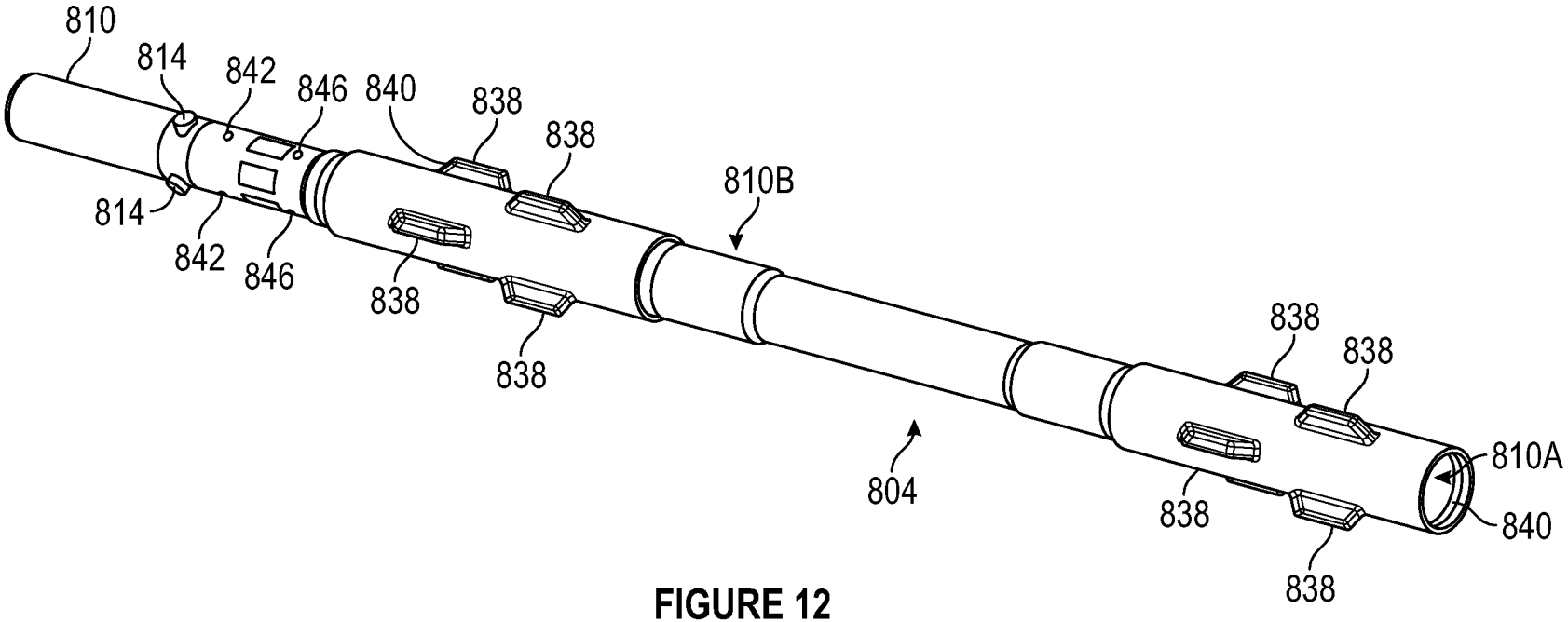
FIG. 12 is a perspective view of a stinger of a reservoir production assembly of the present disclosure.

Referring to FIG. 12, in some embodiments, for example, the stinger 810 is in the form of a mandrel 810B that defines the fluid passage 810A and carries the lugs 814. In some embodiments, for example, one or more centralizers 838 extend radially from the outermost surface of the mandrel 810A for centralizing the stinger 810 relative to the wellbore 102, and thereby facilitating its insertion into the overshot 808. In some embodiments, for example, for each one of the centralizers 838, independently, a solid particulate accumulation-susceptible region 840 is defined by that portion of the outermost surface of the centralizer 838 that is facing uphole and is traversed by a longitudinal axis of the wellbore 102, and at least 50% (such as, for example, at least 60%, such as, for example, at least 70%, such as, for example, at least 80%) of the total surface area of the solid particulate accumulation-susceptible region 840 has a normal axis that is disposed at an acute angle of less than 45 degrees (such as, for example, less than 40 degrees, such as, for example, less than 35 degrees) relative to the longitudinal axis of the wellbore 102.

At a downhole end 844, the stinger 810 threadably connected to the reservoir fluid conductor 202A such that fluid communication is effected between stinger 810 and the reservoir fluid conductor 202A. In this respect, while the reservoir fluid conductor 202 is receiving and conducting reservoir fluid that has entered the wellbore 102 from the subterranean formation, the reservoir fluid is conducted to the reservoir fluid receiver 623 of the flow diverter body 602A via the stinger 810 and the overshot 808.

In some embodiments, for example, while the assembly 10 is being deployed downhole, the stinger 810 is releasably secured relative to the overshot 808 with one or more frangible members 842, such as, for example, one or more shear pins.

In some embodiments, for example, the releasable securement of the stinger 810 relative to the overshot 808 by the one or more frangible members 842 is with effect that the one or more lugs 814 are disposed within a terminus of the j-slot 812 such that the releasably connectible downhole production assembly 202 is suspended by the one or more lugs 814 from the terminus. Referring to FIG. 12, the locations 842A, at which the frangible members 842 effect the securement, are illustrated. Such configuration is provided for minimizing stresses applied to the one or more frangible members 842, thereby mitigating failure of the one or more frangible members 842.

In other embodiments, for example, the releasable securement of the stinger 810 relative to the overshot 808 by the one or more frangible members 842 is with effect that the one or more lugs 814 are disposed within the j-slot 812, and supported by one or more frangible members, such that the releasably connectible downhole production assembly 202 is suspended from the one or more frangible members 846, and the one or more lugs 814 are positioned within the j-slot 812 such that, while the assembly 10 is being deployed downhole, in response to receiving a force based upon impact of the assembly 10 with a wellbore feature (such as, for example, a liner top), there is an absence of interference to movement of the one or more lugs 814, by the one or more frangible members, in an uphole direction within the j-slot 812 (in this respect, in some of these embodiments, the one or more lugs 814 are free to move uphole within the j-slot 812). Referring to FIG. 12, the locations 846A, at which the frangible members effect the securement, are illustrated. This configuration is provided when it is intended to deploy the assembly 10 within a wellbore 102 where there is a risk that the assembly 10 will experience impact forces during deployment, resulting in premature fracture of the one or more frangible members 842 if the one or more frangible members 842 are disposed otherwise in a position that renders them susceptible to receive such impact forces.

In either case, once the assembly 10 is desirably positioned within the wellbore 102, with the packers having been set, the overshot 808 is manipulated such that the one or more frangible members 842 are fractured for effecting release of the stinger 810 from retention relative to the overshot 808, and after the release, the overshot 808 is manipulated such that the one or more lugs become desirable positioned within the j-slot 812 (when the one or more lugs 814 are disposed in position 848 within the j-slot 812, the releasably connectible downhole production assembly 202 is disposed in tension, and when the one or more lugs 814 are disposed in position 850, the releasably connectible downhole production assembly 202 is disposed in compression).

The following outlines the steps of one operational embodiment for connecting the releasably connectible uphole production assembly 601 to the releasably connectible downhole production assembly 202 that has already been positioned within the wellbore 102. In this respect, the connecting involves connecting the overshot 808 to the stinger 810. The releasably connectible uphole production assembly 601, including the overshot 808, is deployed downhole such that the shroud assembly guides the stinger 810 into the overshot 808. Further movement downhole of the overshot 808, relative to the stinger 810, results in the lugs 814 entering the j-slot 812 such that the lugs become disposed in position 850 within the j-slot 812 (see FIGS. 10 and 11). A left hand torque is then applied to the releasably connectible uphole production assembly 601 from the surface such that the lugs 814 will move within the j-slot 812 to the position 848 within the j-slot 812 (see FIGS. 10 and 11), resulting in the releasably connectible downhole production assembly 202 being disposed in tension.

To effect disconnection of the overshot 808 from the stinger 810 and, therefore, the disconnection of the releasably connectible uphole production assembly 601 from the releasably connectible downhole production assembly 202, a left hand torque is applied to the releasably connectible uphole production assembly 601, with effect that the lugs 814 will leave the vertical section of the j-slot 812. Continued application of the left hand torque, combined with a pull in the uphole direction, ensures that the lugs 814 travel through the exiting path of the j-slot 812.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A reservoir production assembly for disposition within a wellbore that extends into a subterranean formation and is lined with a wellbore string, wherein the reservoir production assembly comprises:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space and conducting the received reservoir fluid to the reservoir fluid receiver; and an on-off tool effecting releasable coupling of the reservoir fluid receiver of the flow diverter to the downhole-disposed reservoir fluid-supplying conductor with effect that fluid coupling of the flow diverter to the downhole-disposed reservoir fluid-supplying conductor is effected;

wherein at least a portion of the on-off tool is disposed within the cavity.

2. The reservoir fluid production assembly as claimed in claim 1, further comprising:

a sealed interface effector for becoming disposed in sealing engagement, or substantially sealing engagement, with the wellbore string for establishing a sealed interface;

wherein:

the sealed interface effector and the flow diverter body are co-operatively configured such that, while: (i) the sealed interface effector is disposed in sealing engagement, or substantially sealing engagement, with the wellbore string such that the sealed interface is established, and (ii) the reservoir fluid is being discharged into the reservoir fluid separation space from the reservoir fluid discharge communicator such that the gaseous depleted reservoir fluid is obtained in response to the separation of the gaseous material from the discharged reservoir fluid, bypassing of the gas-depleted reservoir fluid receiver, by the gas-depleted reservoir fluid, is prevented or substantially prevented.

3. The reservoir fluid production assembly as claimed in claim 2, further comprising:

a pump fluidly coupled to the gas-depleted reservoir fluid discharge communicator for pressurizing the discharged gas-depleted reservoir fluid; and a gas-depleted reservoir fluid-producing conductor fluidly coupled to the pump for conducting the pressurized gas-depleted reservoir fluid to the surface.

4. The reservoir fluid production assembly as claimed in claim 1;

wherein the uppermost surface of the on-off tool is disposed within the cavity.

5. The reservoir fluid production assembly as claimed in claim 1;

wherein at least 50% of the total volume of the on-off tool is disposed within the cavity.

6. The reservoir fluid production assembly as claimed in claim 1;

wherein:

the on-off tool includes a tool-based solid particulate accumulation-susceptible region defined by that portion of the outermost surface of the on-off tool that, while the assembly is disposed within the wellbore, is facing uphole and is traversed by a longitudinal axis of the wellbore; and at least 50% of the total surface area of the tool-based solid particulate accumulation-susceptible region is disposed within the cavity.

7. The reservoir fluid production assembly as claimed in claim 1;

wherein the disposition of the at least a portion of the on-off tool within the cavity is with effect that the at least a portion of the on-off tool is shielded, or substantially shielded, from solid particulate matter within the reservoir fluid while the solid particulate matter is being conducted from the reservoir fluid separation space to the gas-depleted reservoir fluid receiver.

8. The reservoir fluid production assembly as claimed in claim 1;

wherein:

the on-off tool includes an overshot and a stinger.

9. The reservoir fluid production assembly as claimed in claim 8;

wherein:

the overshot and the stinger are co-operatively configured such that, while the assembly is disposed within the wellbore, the overshot is disposed uphole relative to the stinger.

10. The reservoir fluid production assembly as claimed in claim 9;

wherein the stinger is releasably connected to the overshot by one or more frangible members.

11. The reservoir fluid production assembly as claimed in claim 10;

wherein the stinger includes one or more centralizers extending laterally from the outermost surface of the stinger.

12. The reservoir fluid production assembly as claimed in claim 11;

wherein, for each one of the one or more centralizers, independently, a centralizer-based solid particulate accumulation-susceptible region is defined by that portion of the outermost surface of the centralizer that, while the assembly is disposed within the wellbore, is facing uphole and is traversed by a longitudinal axis of the wellbore, and at least 50% of the total surface area of the second solid particulate accumulation-susceptible region has a normal axis that is disposed at an acute angle of less than 45 degrees relative to the longitudinal axis of the wellbore.

13. A system for producing hydrocarbon material from a reservoir via a wellbore lined with a wellbore string, comprising:

the reservoir fluid production assembly as claimed in claim 1, disposed within the wellbore such that the sealed interface is established, and oriented such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation.

14. Parts for assembly of a reservoir fluid production assembly, comprising:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space;

wherein:

the flow diverter body includes a first counterpart of an on-off tool;

the downhole-disposed reservoir fluid-supplying conductor includes a second counterpart of the on-off tool;

the first counterpart is configured for interacting with the second counterpart such that the on-off tool is obtained, and such that fluid coupling between the reservoir fluid receiver and the downhole-disposed reservoir fluid-supplying conductor is established for effecting conducting of the received reservoir fluid to the reservoir fluid receiver; and at least a portion of the first counterpart is disposed within the cavity.

15. The parts for assembly as claimed in claim 14;

wherein:

the interaction with the second counterpart, for which the first counterpart is configured, establishes a joint; and the joint is disposed within the cavity.

16. The parts for assembly reservoir fluid production assembly as claimed in claim 15;

wherein:

at least 50% of the total volume of the first counterpart is disposed within the cavity.

17. The parts for assembly reservoir fluid production assembly as claimed in claim 16;

wherein:

the first counterpart includes a first counterpart-based solid particulate accumulation-susceptible region defined by that portion of the outermost surface of the first counterpart that, while: (i) the first counterpart is interacting with the second counterpart such that the on-off tool is obtained, and (ii) the on-off tool is disposed within the wellbore, is facing uphole and is traversed by a longitudinal axis of the wellbore; and the disposition of the at least a portion of the first counterpart within the cavity is such that at least 50% of the total surface area of the first counterpart-based solid particulate accumulation-susceptible region is disposed within the cavity.

18. The parts for assembly as claimed in claim 17;

wherein the disposition of the at least a portion of the first counterpart within the cavity is with effect that, while the assembly, including the first counterpart, is disposed within the wellbore, the at least a portion of the first counterpart is shielded, or substantially shielded, from solid particulate matter within the reservoir fluid while the solid particulate matter is being conducted from the reservoir fluid separation space to the gas-depleted reservoir fluid receiver.

19. The parts for assembly reservoir fluid production assembly as claimed in claim 18;

wherein:

at least a portion of the on-off tool, obtainable in response to the interaction with the second counterpart, for which the first counterpart is configured, is disposed within the cavity.

20. The parts for assembly as claimed in claim 14;

wherein:

the first counterpart includes an overshot; and the second counterpart includes a stinger.

21. The parts for assembly as claimed in claim 20;

wherein the stinger includes one or more centralizers extending laterally from the outermost surface of the stinger.

22. A reservoir production assembly for disposition within a wellbore that extends into a subterranean formation and is lined with a wellbore string, wherein the reservoir production assembly comprises:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space and conducting the received reservoir fluid to the reservoir fluid receiver; and a slideable locking mechanism effecting releasable coupling of the reservoir fluid receiver to the downhole-disposed reservoir fluid-supplying conductor such that fluid coupling of the flow diverter to the downhole-disposed reservoir fluid-supplying conductor is effected;

wherein at least a portion of the slideable locking mechanism is disposed within the cavity.

23. Parts for assembly of a reservoir fluid production assembly, comprising:

a flow diverter body including a cavity;

wherein:

the flow diverter body defines a reservoir fluid receiver, a reservoir fluid-conducting space, and a reservoir fluid discharge communicator, wherein the reservoir fluid receiver, the reservoir fluid-conducting space, and the reservoir fluid discharge communicator are co-operatively configured such that, while reservoir fluid is being received by the reservoir fluid receiver, the reservoir fluid is conducted to the reservoir fluid discharge communicator via the reservoir fluid-conducting space, and discharged into a reservoir fluid separation space of the wellbore from the reservoir fluid discharge communicator with effect that gaseous material is separated from the discharged reservoir fluid such that a gaseous depleted reservoir fluid is obtained;

the flow diverter body also defines a gas-depleted reservoir fluid receiver, a gas-depleted reservoir fluid-conducting space, and a gas-depleted reservoir fluid discharge communicator, wherein the gas-depleted reservoir fluid receiver, the gas-depleted reservoir fluid-conducting space, and the gas-depleted reservoir fluid discharge communicator are co-operatively configured such that, while reservoir fluid is being received by the gas-depleted reservoir fluid receiver, the gas-depleted reservoir fluid is conducted to the gas-depleted reservoir fluid discharge communicator via the gas-depleted reservoir fluid-conducting space, and discharged from the gas-depleted reservoir fluid discharge communicator for supplying to a pump; and the flow diverter is orientable such that, while the reservoir fluid is being discharged into the reservoir fluid separation space from the reservoir fluid discharge communicator such that the gaseous depleted reservoir fluid is obtained in response to the separation of the gaseous material from the discharged reservoir fluid, the gas-depleted reservoir fluid receiver is disposed relative to the reservoir fluid discharge communicator for receiving the gas-depleted reservoir fluid obtained from the separation;

a downhole-disposed reservoir fluid-supplying conductor for receiving the reservoir fluid from a downhole wellbore space;

wherein:

the flow diverter body includes a first counterpart of a slideable locking mechanism;

the downhole-disposed reservoir fluid-supplying conductor includes a second counterpart of the slideable locking mechanism;

the first counterpart is configured for interacting with the second counterpart such that the slideable locking mechanism is obtained, and such that fluid coupling between the reservoir fluid receiver and the downhole-disposed reservoir fluid-supplying conductor is established for effecting conducting of the received reservoir fluid to the reservoir fluid receiver; and at least a portion of the first counterpart is disposed within the cavity.

* * * * *